US008843019B2

(12) United States Patent
Yoshizawa et al.

(10) Patent No.: US 8,843,019 B2
(45) Date of Patent: Sep. 23, 2014

(54) DEVELOPMENT DEVICE AND IMAGE FORMING APPARATUS INCORPORATING SAME

(75) Inventors: Hideo Yoshizawa, Kanagawa (JP); Kiyonori Tsuda, Kanagawa (JP); Takuzi Yoneda, Tokyo (JP); Emi Kita, Kanagawa (JP); Yutaka Takahashi, Kanagawa (JP); Yuki Oshikawa, Kanagawa (JP); Kohichi Utsunomiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 121 days.

(21) Appl. No.: 13/435,168

(22) Filed: Mar. 30, 2012

(65) Prior Publication Data

US 2012/0269553 A1 Oct. 25, 2012

(30) Foreign Application Priority Data

Apr. 25, 2011 (JP) ..... 2011-097637

(51) Int. Cl.
*G03G 15/08* (2006.01)

(52) U.S. Cl.
CPC ..... *G03G 15/0812* (2013.01)
USPC ..... 399/102; 399/103; 399/105

(58) Field of Classification Search
USPC ..... 399/102, 103, 105, 222, 274, 284
See application file for complete search history.

(56) References Cited

U.S. PATENT DOCUMENTS

| | | | | |
|---|---|---|---|---|
| 4,792,831 | A * | 12/1988 | Takeda et al. | 399/105 |
| 7,826,776 | B2 | 11/2010 | Tsuda et al. | |
| 7,890,028 | B2 | 2/2011 | Miyamoto et al. | |
| 7,899,368 | B2 | 3/2011 | Yoshida et al. | |
| 7,937,027 | B2 | 5/2011 | Kato et al. | |
| 7,962,071 | B2 | 6/2011 | Tsuda et al. | |
| 8,010,020 | B2 | 8/2011 | Kita et al. | |
| 8,135,311 | B2 | 3/2012 | Tsuda et al. | |
| 8,145,101 | B2 | 3/2012 | Terai et al. | |
| 2008/0187332 | A1 | 8/2008 | Tsuda et al. | |
| 2008/0253810 | A1 | 10/2008 | Tateyama et al. | |

FOREIGN PATENT DOCUMENTS

| | | |
|---|---|---|
| JP | 9-43981 | 2/1997 |
| JP | 11-161012 | 6/1999 |
| JP | 2008-181047 | 8/2008 |
| JP | 2009-58944 | 3/2009 |

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A development device includes a development casing, a developer bearer disposed facing a latent image bearer through an opening in the development casing to carry developer, a magnetic field generator disposed inside the developer bearer, a developer regulator extending in an axial direction of the developer bearer to adjust an amount of developer carried on the developer bearer, and a first axial end seal provided in an axial end portion of the development device outside an image range, in contact with an upstream face of the developer regulator to reduce a size of a clearance between the developer regulator and the development casing.

15 Claims, 8 Drawing Sheets

DEVELOPMENT DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-097637, filed on Apr. 25, 2011, in the Japan Patent Office, the entire disclosure of which is hereby incorporated by reference herein.

FIELD OF THE INVENTION

This invention generally relates to a development device used in an image forming apparatus, such as a copier, a printer, a facsimile machine, and a multifunction machine including at least two of these functions, and an image forming apparatus including the development device.

BACKGROUND OF THE INVENTION

Typical development devices include a developer bearer inside which a magnetic field generator is provided to carry developer on the surface of the developer bearer and a developer regulator to adjust the amount of developer carried on the developer bearer. Developer is carried on the surface of the developer bearer due to the magnetic force exerted by the magnetic field generator and conveyed to a development range as the developer bearer rotates. The developer regulator extends in a width direction perpendicular to the direction of rotation of the developer bearer and is disposed with a tip thereof facing the surface of the developer bearer across a predetermined clearance (i.e., a regulation gap). The developer regulator regulates the amount of developer passing through the regulation gap, carried on the developer bearer.

Typically, the magnetic field generator does not present in end portions in the width direction (i.e., axial end portions) of the developer bearer outside an image area because the end portions do not need to carry the developer. Although the axial end portions of the developer bearer are not designed to carry developer, in practice, among the developer conveyed toward the regulation gap, the developer blocked by the developer regulator is pushed to the axial end portion.

The developer that has reached the axial ends then inevitably moves through the gap between the developer regulator and the developer bearer. In the axial end portions, the effects of the magnetic force exerted by the magnet roller are small. Accordingly, it is possible that the developer leaves the surface of the developer bearer and scatters. The scattering developer can adhere to other components, resulting in contamination inside the apparatus or adhere to sheets of recording media, thus degrading image quality.

BRIEF SUMMARY OF THE INVENTION

In view of the foregoing, one embodiment of the present invention provides a development device that includes a development casing, a developer bearer disposed facing a latent image bearer through an opening formed in the development casing, a magnetic field generator disposed inside the developer bearer, a developer regulator to adjust an amount of developer carried on the developer bearer, and a first axial end seal provided in an axial end portion of the development device outside an image range. The developer bearer carries by rotation two-component developer including toner and carrier. The developer regulator extends in an axial direction of the developer bearer perpendicular to a direction of rotation of the developer bearer, and an end face of the developer regulator faces the developer bearer across a predetermined regulation gap. The first axial end seal is disposed in contact with an upstream face of the developer regulator in the direction of rotation of the developer bearer to reduce a size of a clearance ($C_1$) between the developer regulator and the development casing.

In another embodiment, an image forming apparatus includes a latent image bearer, a latent image forming unit to form a latent image on the latent image bearer, and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
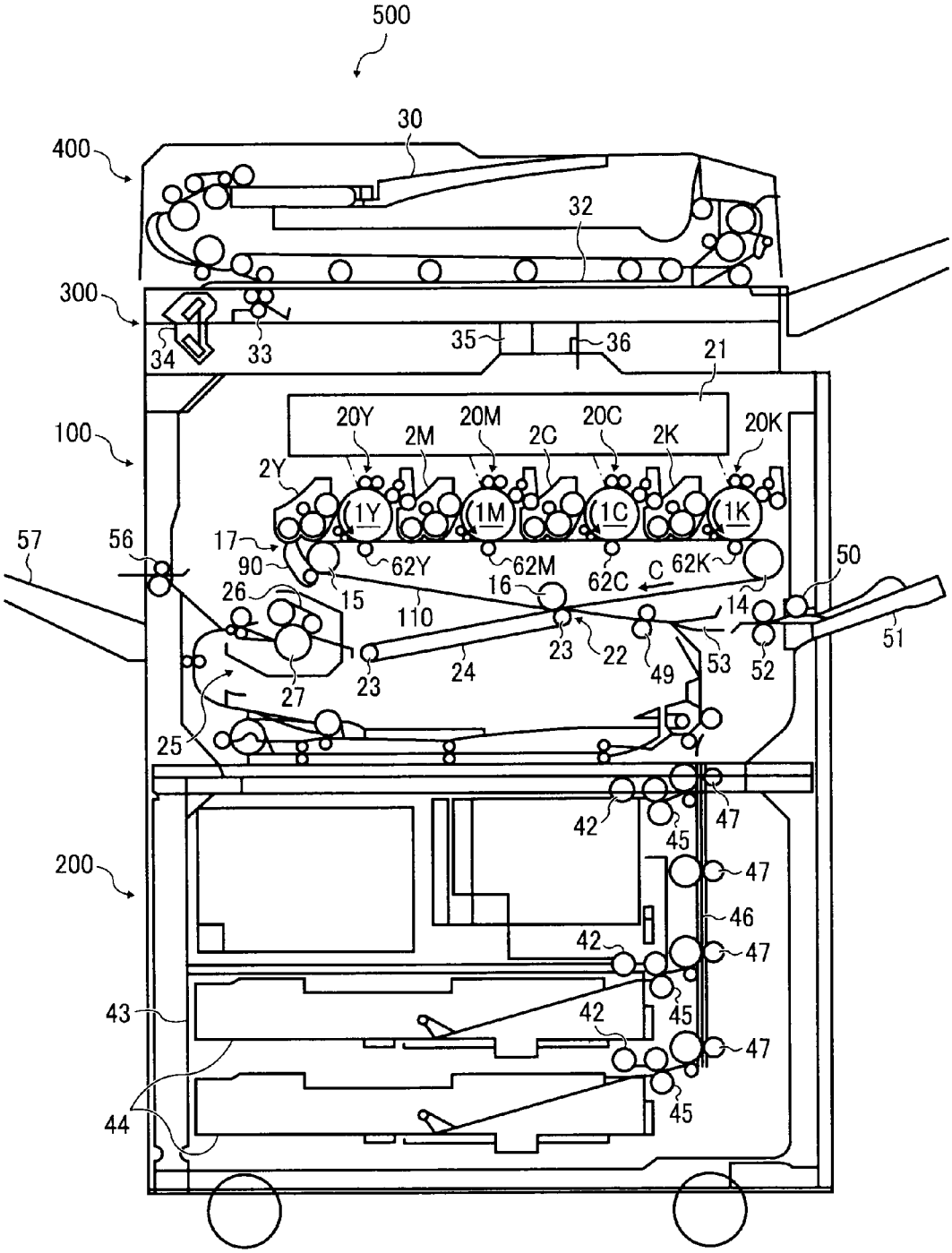
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic diagram that illustrates a configuration of an image forming apparatus 500 according to the present embodiment.

The image forming apparatus 500 shown in FIG. 1 can be, for example, a copier, and includes a printer unit 100, a sheet feeder 200 on which the printer unit 100 is mounted, and a scanner 300 fixed above the printer unit 100. The image forming apparatus 500 further includes an automatic document feeder (ADF) 400 fixed on the scanner 300.

The printer unit 100 includes four image forming units 20Y, 20M, 20C, and 20K for forming yellow (Y), magenta (M), cyan (M), and black (K) images. The image forming apparatus 500 further includes an optical writing unit 21, an intermediate transfer unit 17, a secondary transfer device 22, a pair of registration rollers 49, and a belt-type fixing device 25.

The optical writing unit 21 includes a light source, a polygon mirror, an f-θ lens, and reflection mirrors, and is configured to direct a laser beam onto surfaces of four photoreceptors 1 according to image data.

Figure 2:
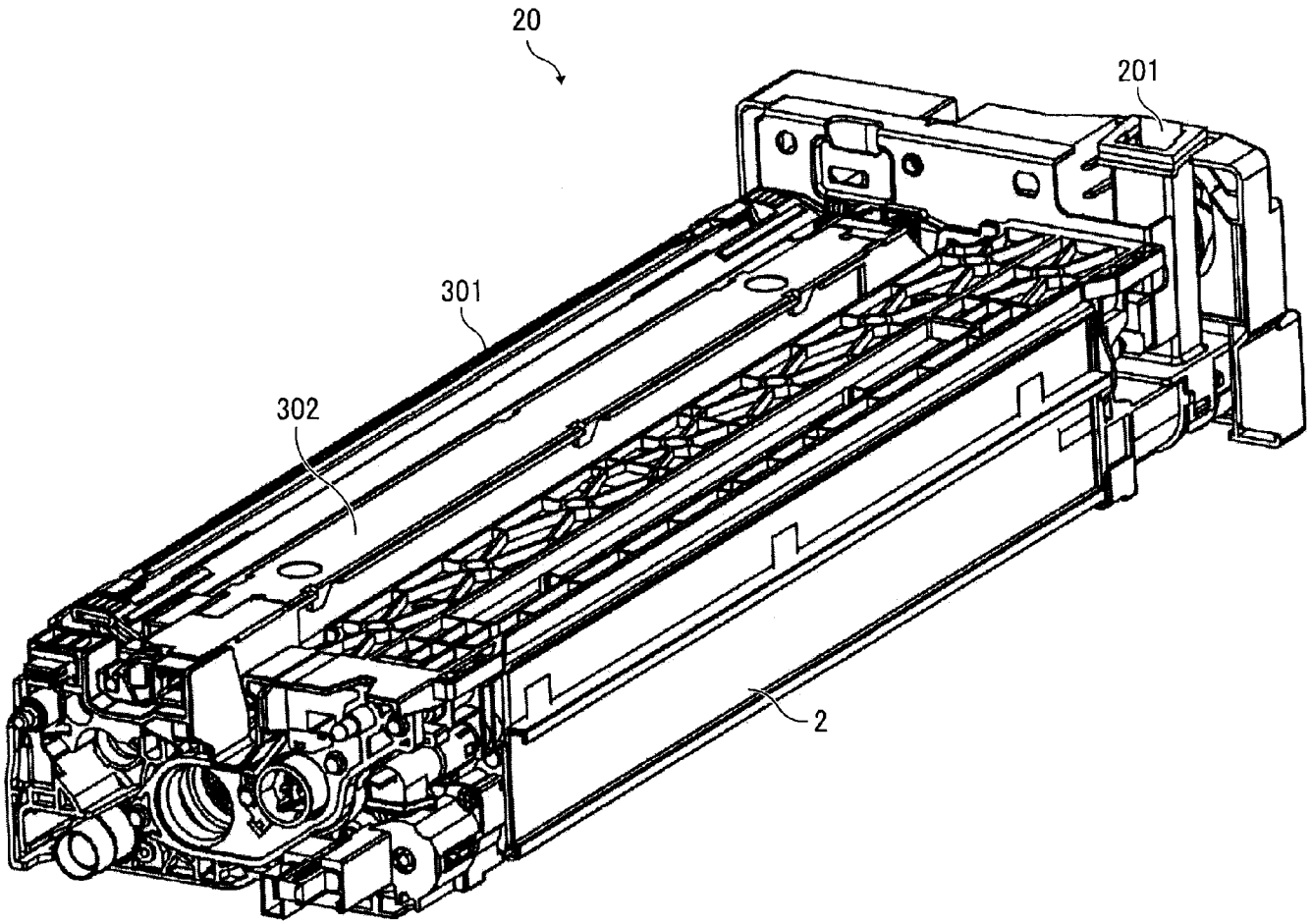
FIG. 2 is a perspective view illustrating an image forming unit.

FIG. 2 is a perspective view of one of the four image forming units 20 as viewed from the bask side of the paper on which FIG. 1 is drawn.

In each image forming unit 20, the drum-shaped photoreceptor 1 and the components, such as a charging device 302, a development device 2, a drum cleaning unit 301, and a discharger, provided around the photoreceptor 1 may be supported by a common frame (supporter), forming a process cartridge (modular unit) removably installable in a main body (e.g., printer unit 100) of the image forming apparatus 500. The printer unit 100 of the image forming apparatus 500 according to the present embodiment includes four process cartridges arranged in parallel to each other.

It is to be noted that reference numeral 201 shown in FIG. 2 represents a toner supply inlet formed in the development device 2.

The image forming units 20 are described in further detail below using the image forming unit 20 for yellow.

The surface of the photoreceptor 1Y is uniformly charged by the charging device 302Y. Then, the optical writing unit 21 directs the laser beam, which is modulated and deflected, to the charged surface of the photoreceptor 1Y. The laser beam (exposure light) attenuates the electrical potential of the portion of the photoreceptor 1Y thus exposed, forming an electrostatic latent image for yellow thereon. Then, the development device 2Y develops the electrostatic latent image formed on the photoreceptor 1Y with developer into a yellow toner image. The yellow toner image is primarily transferred from the photoreceptor 1Y onto the intermediate transfer belt 110.

Subsequently, the drum cleaning unit 301Y removes toner remaining on the surface of the photoreceptor 1Y. Further, the discharger removes electrical potential remaining on the photoreceptor 1Y, after which the charging device 302Y uniformly charges the surface of the photoreceptor 1Y, thus initializing the photoreceptor 1Y The above-described processes are also performed in other image forming units 20 similarly.

Next, the intermediate transfer unit 17 is described below.

The intermediate transfer unit 17 includes the intermediate transfer belt 110, a belt cleaning unit 90, a tension roller 14, a driving roller 15, a backup roller 16, and four primary-transfer bias rollers 62. The intermediate transfer belt 110 is stretched around multiple rollers including the tension roller 16 and rotates clockwise in FIG. 1 as the driving roller 15 rotates, driven by a belt driving motor. The four primary-transfer bias rollers 62 are disposed in contact with an inner circumferential surface of the intermediate transfer belt 110 and receive a primary transfer bias from a power source.

The four primary-transfer bias rollers 62 press the intermediate transfer belt 110 against the respective photoreceptors 1 from the inner circumferential side, forming primary-transfer nips therebetween. The primary transfer bias causes a primary-transfer electrical field between the photoreceptor 1 and the primary-transfer bias roller 62 in each primary-transfer nip. The yellow toner image is transferred from the photoreceptor 1Y onto the intermediate transfer belt 110 with the effects of the primary-transfer electrical field and the nip pressure. Subsequently, magenta, cyan, and black toner images are transferred from the photoreceptors 1M, 1C, and 1K and superimposed one on another on the yellow toner image. Thus, a superimposed four-color toner image is formed on the intermediate transfer belt 110.

The four-color toner image formed on the intermediate transfer belt 110 is transferred in a secondary-transfer nip onto a sheet (recording medium) transported from the sheet feeder 200 (secondary-transfer process). The belt cleaning unit 90 is provided downstream from the secondary-transfer nip in a direction in which the sheet is transported (hereinafter "sheet conveyance direction"), pressing against the driving roller 15 via the intermediate transfer belt 110. The belt cleaning unit 90 removes any toner remaining on the intermediate transfer belt 110 after the secondary transfer process.

The secondary transfer device 22 is described in further detail below.

The secondary transfer device 22 is disposed beneath the intermediate transfer unit 17 in FIG. 1 and includes a conveyance belt 24 looped around two tension rollers 23. The conveyance belt 24 rotates counterclockwise in FIG. 1 as at least one of the two tension rollers 23 rotates. The intermediate transfer belt 110 and the conveyance belt 24 are nipped between the backup roller 16 and the tension roller 23 on the right in FIG. 1. Thus, the intermediate transfer belt 110 is in contact with the conveyance belt 24, forming the secondary-transfer nip.

A secondary-transfer bias whose polarity is opposite to the polarity of toner is applied to the tension roller 23 on the right from a power source. The secondary-transfer bias causes a secondary-transfer electrical field in the secondary-transfer nip to electrically transfer the four-color toner image from the intermediate transfer belt 110 toward the tension roller 23. Timed to coincide with transferring of the four-color toner image, the registration rollers 49 forward the sheet to the secondary-transfer nip, and the four-color toner image is secondarily transferred on the sheet. It is to be noted that, instead of applying the secondary-transfer bias to one of the tension rollers 23, a contactless charger to charge the sheet may be provided.

The sheet feeder 200 disposed beneath the main body of the apparatus includes a paper bank 43 in which multiple sheet cassettes 44 are arranged vertically. Each sheet cassette 44 contains multiple sheets stacked on top of another. Each sheet cassette 44 is provided with a feed roller 42 pressed against the sheet on the top in the sheet cassette 44. As the feed roller 42 rotates, the sheet is conveyed to a feeding path 46.

Multiple pairs of conveyance rollers 47 are provided along the feeding path 46, and the pair of registration rollers 49 is provided at an end portion of the feeding path 46. The sheet is conveyed toward the registration rollers 49 and then clamped in the nip between the registration rollers 49.

Meanwhile, the four-color toner image formed on the intermediate transfer belt 110 is transported to the secondary-transfer nip as the intermediate transfer belt 110 rotates. The registration rollers 49 forward the sheet clamped therebetween so that it can contact the four-color image in the secondary-transfer nip. Thus, the four-color toner image is transferred onto the sheet in the secondary-transfer nip, forming a full-color image on the while sheet. As the conveyance belt 24 rotates, the sheet carrying the full-color toner image is discharged from the secondary-transfer nip and conveyed to the fixing device 25.

The fixing device 25 includes a belt unit to rotate a fixing belt 26 looped around two rollers as well as a pressure roller 27 pressed against one of the two rollers of the belt unit. The fixing belt 26 and the pressure roller 27 press against each other, forming a fixing nip therebetween, and the sheet conveyed by the conveyance belt 24 is clamped in the fixing nip. A heat source to heat the fixing belt 26 is provided inside the roller against which the pressure roller 27 presses. With the heat and pressure, the toner image is fixed on the sheet in the fixing nip (fixing process).

After the fixing process, discharge rollers 56 discharge the sheet to a stack tray 57 protruding from a side (on the left in FIG. 1) of the housing of the image forming apparatus 500. Alternatively, the sheet is conveyed again to the secondary-transfer nip for duplex printing.

To make copies of a bundle of originals, users can place the bundle of originals, for example, on a document table 30 of the ADF 400. It is to be noted that, if the bundle of originals is bound like a book on one side (side-stitched documents), the bundle is placed on an exposure glass 32 of the scanner 300. Specifically, the user lifts the ADF 400 to expose the exposure glass 32 of the scanner 300, sets the bundle on the exposure glass 32, and then lowers the ADF 400 so as to hold the bundle with the ADF 400.

Then, the user presses a copy start switch, and the scanner 300 starts reading image data of the originals. When the originals are set on the ADF 400, the ADF 400 automatically conveys the originals to the exposure glass 32 before reading of image data. In reading of image data, the first and second carriages 33 and 34 start moving, and the first carriage 33 directs an optical beam from the light source onto the original. Subsequently, the optical beam reflected from a surface of the original is reflected by the mirror of the second carriage 34, passes through the imaging lens 35, and then enters the reading sensor 36. Thus, the reading sensor 36 obtains the image data of the original document.

In parallel to reading of image data, components of the respective image forming units 20, the intermediate transfer unit 17, the secondary transfer device 22, and the fixing device 25 start operating. According to the image data obtained by the reading sensor 36, the optical writing unit 21 is driven, and yellow, magenta, cyan, and black toner images are formed on the photoreceptors 1Y, 1M, 1C, and 1K, respectively.

Additionally, almost simultaneously with the start of image data reading, the sheet feeder 200 starts feeding sheets. Specifically, one of the feed rollers 42 is selectively rotated, and the sheets are fed from the corresponding sheet cassette 44. The sheets are fed one by one to the feeding path 46, separated by a separation roller 45, after which the pairs of conveyance rollers 47 convey the sheet to the secondary-transfer nip. Instead of the sheet cassette 44, the sheets may be fed from a side tray (external tray) 51 projecting from the side of the apparatus. In this case, a feed roller 50 is rotated to feed the sheets from the side tray 51, and a separation roller 52 forwards the sheets one by one to a feed path 53 inside the printer unit 100.

When multicolor toner images are formed, the intermediate transfer belt 110 is disposed with its upper portion substantially horizontal so that the photoreceptors 1Y, 1M, 1C, and 1K are in contact with the upper side of the intermediate transfer belt 110. By contrast, when monochrome images (black toner images) are formed, the left side of the intermediate transfer belt 110 in FIG. 1 is lowered, thus disengaging the intermediate transfer belt 110 from the photoreceptors 1Y, 1M, and 1C. Then, only the photoreceptor 1K among the four photoreceptors 1 is rotated counterclockwise in FIG. 1. At that time, not only the photoreceptor 1 but also the development device 2 is stopped in each of the image forming units 20Y, 20M, and 20C to prevent wear of the photoreceptors 1 or waste of developer.

Although not shown in FIG. 1, the image forming apparatus 500 further includes a controller for controlling operations of respective parts thereof and an operation panel including a display and various keys. Regarding simplex printing to form an image on only one side of the sheet, the image forming apparatus 500 can offer three different modes: a direct discharge mode, a reverse discharge mode, and a reverse decal discharge mode. The user can select one of these modes by sending a command to the controller from the operation panel.

Figure 3:
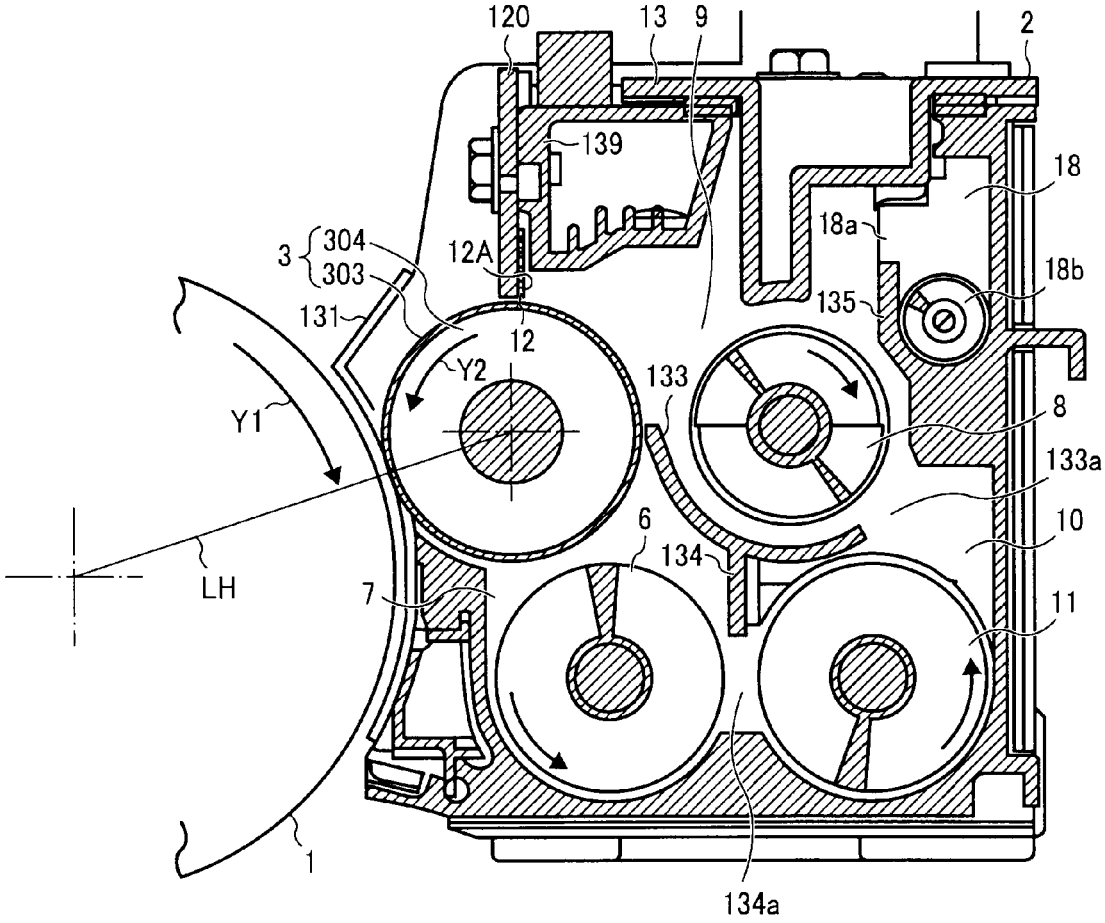
FIG. 3 is an end-on axial view of a development device.

FIG. 3 is an end-on axial view illustrating a schematic configuration of the development device 2 provided in the image forming unit 20. FIG. 3 is a cross-sectional view illustrating an end portion on the back side of the paper on which FIG. 2 is drawn (front side of the paper on which FIG. 1 is drawn).

Figure 4:
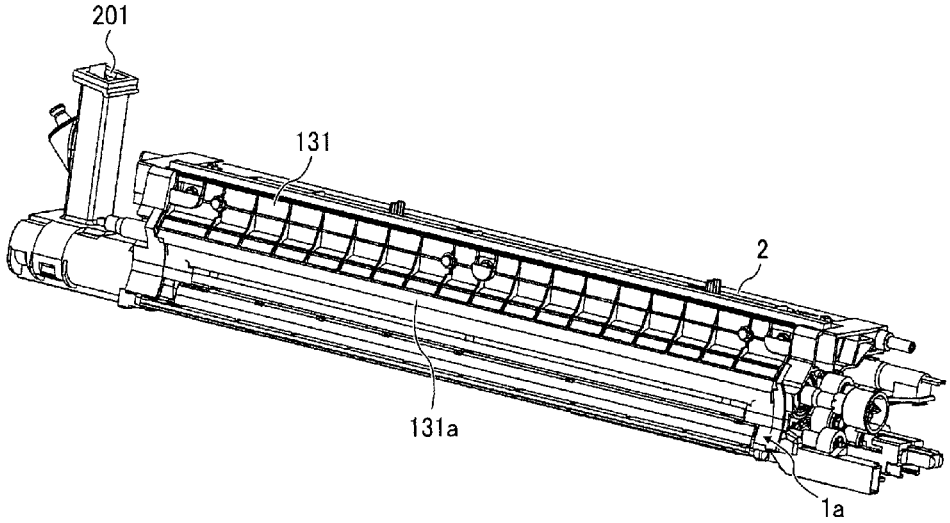
FIG. 4 is a perspective view of the development device shown in FIG. 3.

FIG. 4 is a perspective view of the development device 2 without other components, such as the photoreceptor 1, of the image forming unit 20. When the development device 2 is incorporated in the image forming unit 20, the photoreceptor 1 is positioned at a position 1*a* shown in FIG. 4.

Referring to FIG. 3, the development device 2 includes a development casing 13 for containing two-component developer consisting essentially of toner and magnetic carrier and a development roller 3 serving as a developer bearer to carry thereon the developer. An opening is formed in the development casing 13 at a position facing the photoreceptor 1, which rotates clockwise in FIG. 3 as indicated by arrow Y1, and the development roller 3 is partly exposed from the opening. The development roller 3 rotates counterclockwise in FIG. 3 as indicated by arrow Y2. The development roller 3 is disposed so that a minute clearance is kept between the exposed surface thereof and the surface of the photoreceptor 1.

The development roller 3 includes a cylindrical development sleeve 303 constructed of an electroconductive, non-magnetic material and a magnet roller 304 disposed inside the development sleeve 303. The magnet roller 304 includes multiple stationary magnetic poles. The development sleeve 303 serves as a developer bearer, and the magnet roller 304 serves as the magnetic field generator to generate a magnetic field at least in the portion facing a developer doctor 120.

The development sleeve 303 rotates, thus moving relatively to the magnet roller 304, in a direction following the direction of rotation of the photoreceptor 1 indicated by arrow Y1. Further, a power source is connected to the development sleeve 303 to apply a development bias thereto. When the development bias is applied to the development sleeve 303, an electrical field (i.e., development field) is formed between the surface of the development roller 3 and the surface of the photoreceptor 1 in a development range where the development roller 3 faces the photoreceptor 1.

The development field causes toner contained in the developer carried on the surface of the development roller 3 to adhere to the electrostatic latent image formed on the photoreceptor 1, thus developing it into a toner image. In image development, the magnetic field formed by the magnet roller 304 causes the magnetic carrier in the developer to stand on end on the development sleeve 303 in the development range, thus forming a magnetic brush.

The development device 2 further includes the developer doctor 120 (i.e., a doctor blade) and a magnetic plate 12. The developer doctor 120 and the magnetic plate 12 together form a developer regulator that adjusts the amount of developer carried to the development range, carried on the surface of the development roller 3. The developer regulator formed by the developer doctor 120 and the magnetic plate 12 has an end face F1 facing the development roller 3 across the predetermined gap (i.e., a regulation gap).

The magnetic plate 12 is fixed to an upstream face of the developer doctor 120 in the direction of rotation of the development roller 3. The developer doctor 120 is fixed to an upper casing 139, which forms a part of the development casing 13, and accordingly the magnetic plate 12 is fixed to the upper casing 139 via the developer doctor 120. The developer doctor 120 and the magnetic plate 12 extend in the width direction perpendicular to the direction of rotation of the development roller 3 and in parallel to the surface of the development roller 3.

It is to be noted that reference character 12A (shown in FIG. 3) represents an upstream face of the magnetic plate 12 in the direction of rotation of the development roller 3, and LH (shown in FIG. 3) represents a line passing through axial centers of the development roller 3 and the photoreceptor 1.

The development casing 13 further includes an opening rim 131 positioned downstream from the developer doctor 120 in the direction of rotation of the development roller 3 and extends to the opening (development range), thus covering the downstream side of the developer doctor 120. The opening rim 131 serves as a rim portion adjacent to the opening, and an opening seal 131*a* is bonded to the opening rim 131 as shown in FIG. 4.

The developing device 2 further includes a supply screw 8 and a collecting screw 6 positioned downstream from the development range where the development roller 3 faces the photoreceptor 1 in the direction of rotation of the development roller 3. The supply screw 8 transports the developer to the back side of the paper on which FIG. 2 is drawn while supplying the developer to the development roller 3. The collecting screw 6 collects the developer that has passed through the development range and transports the collected developer in the direction identical to the direction in which the supply screw 8 transports the developer (hereinafter "developer conveyance direction"). The development roller 3 and a supply compartment 9 in which the supply screw 8 is provided are arranged laterally, and a collecting compartment 7 in which the collecting screw 6 is provided is positioned beneath the development roller 3. The development device 2 further includes an agitation compartment 10 beneath the supply compartment 9 and in parallel to the collecting compartment 7. In the agitation compartment 10, an agitation screw 11 is provided to transport the developer toward the front side of the paper on which FIG. 2 is drawn while agitating the developer. The agitation screw 11 transports the developer in the direction opposite the developer conveyance direction of the supply screw 8.

The development device 2 further includes a first separation wall 133 that includes a portion separating the supply compartment 9 from the agitation compartment 10.

Although separated by the first separation wall 133, the supply compartment 9 and the agitation compartment 10 communicate with each other in both axial end portions, which are respectively on the front side and the back side of the paper on which FIG. 3 is drawn. Additionally, a second separation wall 134 that includes a portion separating the agitation compartment 10 from the collecting compartment 7 is provided. Although separated by the second separation wall 134, an opening 134*a* is formed in an end portion of the second separation wall 134, which is on the back side of the paper on which FIG. 3 is drawn, and thus the agitation compartment 10 communicates with the collecting compartment 7. It is to be noted that the supply compartment 9 and the collecting compartment 7 are separated by the first partition 133 as well, and no opening is formed in that portion of the first partition 133. Thus, the supply compartment 9 does not communicate with the collecting compartment 7.

After being used in image development, developer is collected in the collecting compartment 7 and then is conveyed to the back side of the paper on which FIG. 2 is drawn. The collected developer is further conveyed through the opening 134*a* formed in the second separation wall 134, in a non-image area, to the agitation compartment 10. It is to be noted that premixed toner, in which toner and carrier are mixed, is supplied to the agitation compartment 10 through the toner supply inlet 201 (shown in FIG. 2) formed on an upper side of an upstream end portion of the agitation compartment 10.

The supply compartment 9 includes a discharge path 18 to discharge the developer from the supply compartment 9 outside the development device 2 when the amount of developer inside the development device 2 becomes excessive resulting from the supply of premixed toner or the like. The developer is discharged through a discharge opening 18*a* to the discharge path 18, and a discharge screw 18*b* is provided in the discharge path 18. Specifically, the discharge path 18 is formed by a partition 135 and the development casing 13 and is positioned on the side of the supply compartment 9 via the partition 135. The discharge opening 18*a* is formed in an end portion of the partition 135 on the downstream side in the developer conveyance direction in the supply compartment 9 (on the back side in FIG. 2 and the same position as the cross section shown in FIG. 3). That is, the discharge opening 18*a* serves as a communication portion between the supply compartment 9 and the discharge path 18.

Next, circulation of developer inside the three compartments formed in the development casing 13 (i.e., a developer container) is described below.

In the supply compartment 9, the supply screw 8 transports the developer supplied from the agitation compartment 10 downstream while supplying it to the development roller 3. The developer that is not supplied to the development roller 3 but is transported to the downstream end portion of the supply compartment 9 (i.e., excessive developer) is transported through an opening 133*a* for excessive developer formed in the first separation wall 133 to the agitation compartment 10. The developer collected from the development roller 3 in the collecting compartment 7 is transported by the collection screw 6 to a downstream end portion of the collecting compartment 7, after which the collected developer is transported to the agitation compartment 10 through the opening 134*a* formed in the second separation wall 134. In the agitation compartment 10, the excessive developer and the collected developer are mixed together and transported by the agitation screw 11 to a downstream end portion of the agitation compartment 10, which is on the upstream side in the conveyance direction of the supply screw 8. Then, the developer is transported through the opening formed in the first separation wall 133 to the supply compartment 9.

In the agitation compartment 10, the agitation screw 11 transports the collected developer, the excessive developer, and toner supplied through the toner supply inlet 201 as required in the direction opposite the direction in which the developer is transported in the collecting compartment 7 as well as the supply compartment 9. Subsequently, the developer is transported from the downstream end portion of the agitation compartment 10 to an upstream end portion of the supply compartment 9 through the opening. It is to be noted that a toner concentration detector is provided beneath the agitation compartment 10, and premixed toner is supplied by a toner supply device from a toner container according to outputs from the toner concentration detector.

In the above-described development device 2, the used developer does not directly enter the supply compartment 9 because supply and collection of developer are performed in the supply compartment 9 and the collecting compartment 7, respectively. Therefore, decreases in toner concentration in the developer supplied to the development roller 3 on the downstream side in the supply compartment 9 can be prevented or reduced. Additionally, collection and agitation of developer are performed in different developer conveyance compartments, namely, the collecting compartment 7 and the agitation compartment 10, which can prevent the used developer from being supplied to the development roller 3 during agitation. Therefore, only sufficiently agitated developer is allowed to enter the supply compartment 9. In other words, decreases in concentration of toner in the developer in the supply compartment 9 can be prevented or alleviated, and accordingly image density can be kept constant.

Figure 5:
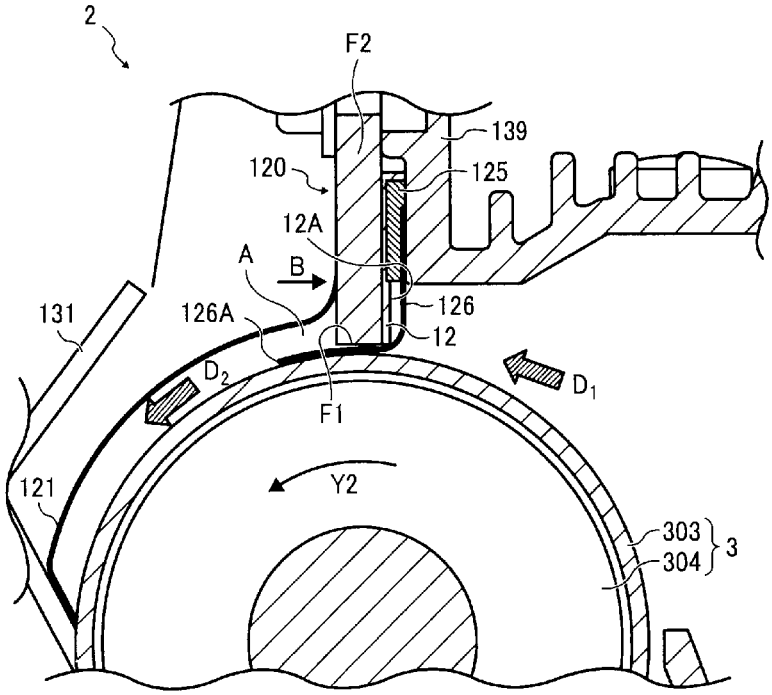
FIG. 5 is an enlarged view illustrating a development regulator and the adjacent portion in the development device according to an embodiment.
Figure 6:
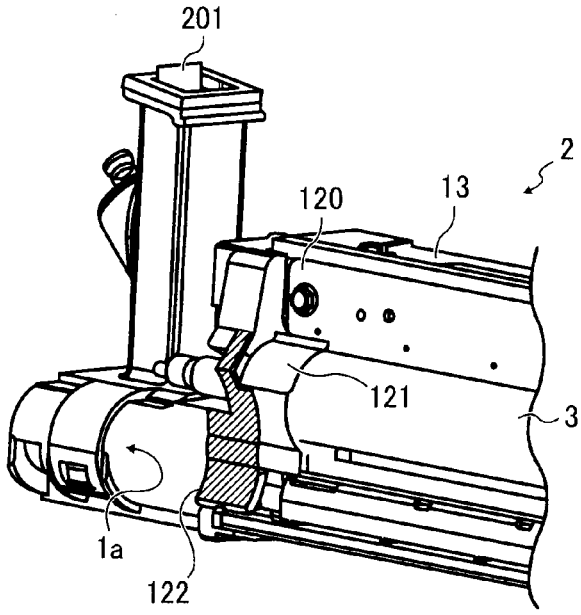
FIG. 6 is a perspective view illustrating the development device from which a rim portion of the development casing enclosing the opening (i.e., an opening rim) is removed.

FIG. 5 is an enlarged cross-sectional view illustrating a configuration in the axial end portion adjacent to the developer doctor 120 (on the same cross section as shown in FIG. 3). FIG. 6 is an enlarged cross-sectional view of the axial end portion of the development device 2 (on the left in FIG. 4) from which the opening rim 131 is removed.

It is to be noted that, in FIG. 5, reference character A represents an area downstream from the developer doctor 120 in the direction of rotation of the development roller 3, and arrows $D_1$ and $D_2$ represent flow of developer.

As shown in FIGS. 5 and 6, a development-side seal 121 (cover) is provided in an axial end portion and downstream from the developer doctor 120 in the direction of rotation of the development roller 3 indicated by arrow Y2. The development-side seal 121 is a flexible elastic member, and a lower end portion thereof is fixed to the development casing 13. Due to the elasticity thereof, an upper end portion of the development-side seal 121 presses, as indicated by arrow B shown in FIG. 5, a downstream face of the developer doctor 120 in the direction of rotation of the development roller 3. The development-side seal 121 is designed to prevent scattering of developer downstream from the regulation gap.

Additionally, as shown in FIG. 6, a photoreceptor seal member 122 is provided in an axial end portion of the position 1*a* where the photoreceptor 1 is disposed. The photoreceptor seal member 122 is provided between the photoreceptor 1 and the development casing 13 to shield the photoreceptor 1. As shown in FIG. 6, the photoreceptor seal member 122 is disposed to hold a lower side of the development-side seal 121. The development-side seal 121 and the photoreceptor seal member 122 may be provided in either axial end portion.

Next, a distinctive feature of the present embodiment is described below with reference to FIG. 5.

The development device 2 further includes a doctor end seal 125 (first axial end seal) constructed of an elastic material such as sponge and disposed in contact with the upstream face 12A of the magnetic plate 12 in the direction of rotation of the development roller 3. The upstream face 12A of the magnetic plate 12 stands vertically from an upstream edge of the end face F1 of the developer regulator (developer doctor 120 and the magnetic plate 12). The doctor end seal 125 is positioned in an axial end portion that is a non-image area outside the image area where an image can be formed on the photoreceptor 1. Specifically, in the image area positioned in an axial center portion (a center portion in the width direction), the amount of developer carried on the development sleeve 303 due to the magnetic force exerted by the magnet roller 304 is adjusted with the regulation gap, and an appropriate amount of developer is conveyed to the development range.

Additionally, a flexible sheet member 126 (second axial end seal) constructed of, for example, urethane is provided with a first end portion thereof interposed between the doctor end seal 125 and the upper casing 139, thus being fixed to the development casing 13, and a second end portion 126A thereof not fixed (i.e., a free end). The second end portion 126A of the flexible sheet member 126 contacts the surface of the development roller 3 in the axial end portion.

The second end portion 126A of the flexible sheet member 126 follows rotation of the development roller 3 and is positioned downstream in the direction of rotation of the development roller 3 from the regulation gap between the developer doctor 120 and the development roller 3. The development-side seal 121 serves as a cover for the second end portion 126A of the flexible sheet member 126 (second axial end seal).

It is to be noted that two doctor end seals 125 and two flexible sheet members 126 may be provided in the respective axial end portions.

Next, a procedure of installation of the doctor end seals 125 and the seal members 126 is described below.

Figure 7:
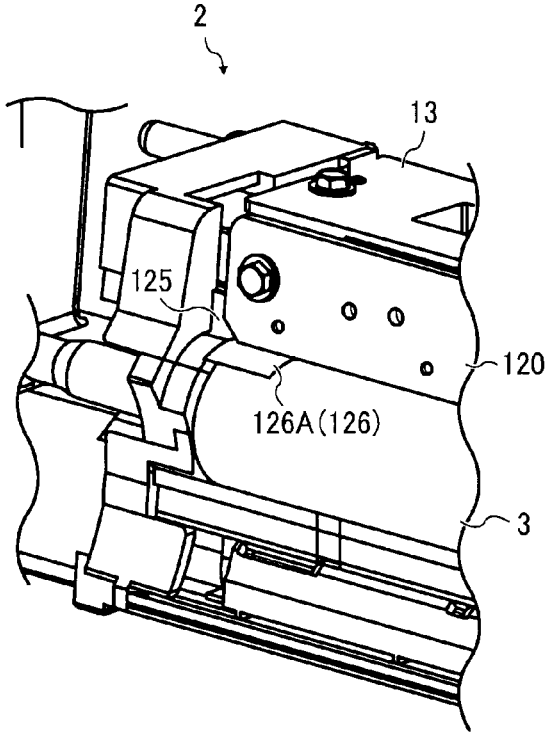
FIG. 7 is a perspective view illustrating the development device shown in FIG. 6 from which a photoreceptor seal member and a development-side seal are removed.
Figure 8:
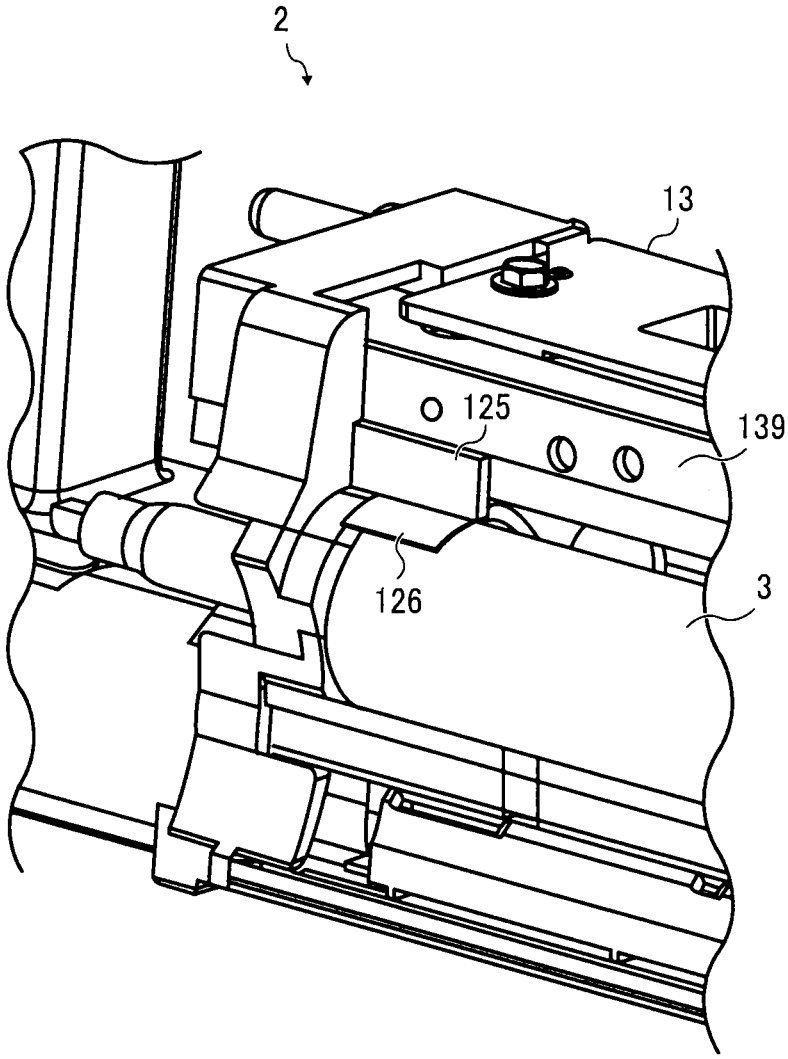
FIG. 8 is a perspective view illustrating the development device from which the developer regulator is removed.

FIG. 7 is a perspective view illustrating the development device 2 from which the photoreceptor seal members 122 and the development-side seals 121 are removed. FIG. 8 is a perspective view illustrating the development device 2 from which the developer doctor 120 is removed.

Referring to FIG. 7, initially, the first end portion of the flexible sheet member 126 is fixed to the upper casing 139, and the free end, namely, the second end portion 126A (shown in FIG. 7), of the flexible sheet member 126 is disposed downstream (to the front side of the paper on which FIG. 8 is drawn) from the first end portion thereof in the direction of rotation of the development roller 3 and hung over the development roller 3. Additionally, the doctor end seal 125 is fixed to the upper casing 139 to cover a portion of the flexible sheet member 126 that is in contact with the upper casing 139.

Subsequently, referring to FIG. 7, the developer doctor 120 is fixed to the upper casing 139. In the present embodiment, the sum of a thickness of the flexible sheet member 126 and a thickness of the doctor end seal 125 is greater than a thickness of a clearance $C_1$ (shown in FIGS. 9A and 9B) between the magnetic plate 12 and the upper casing 139 (e.g., length in the direction of rotation of the development roller 3). With this configuration, as shown in FIG. 5, the doctor end seal 125 can be disposed to contact the upstream face 12A of the magnetic plate 12 in the direction of rotation of the development roller 3.

Next, scattering of developer in a comparative development device is described below with reference to FIGS. 9A and 9B.

Figure 9A:
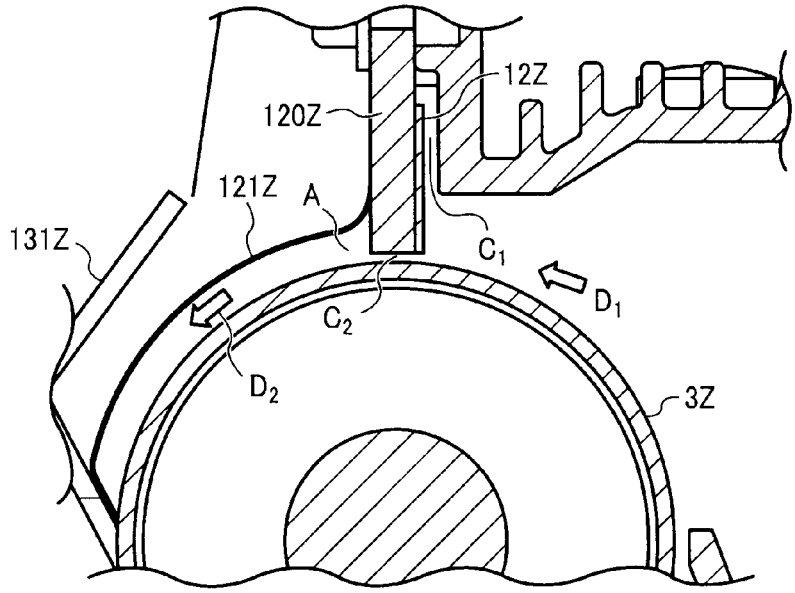
FIG. 9A is an enlarged view illustrating a configuration around a developer regulator in a comparative development device in which a development-side seal and the developer regulator are in contact with each other.
Figure 9B:
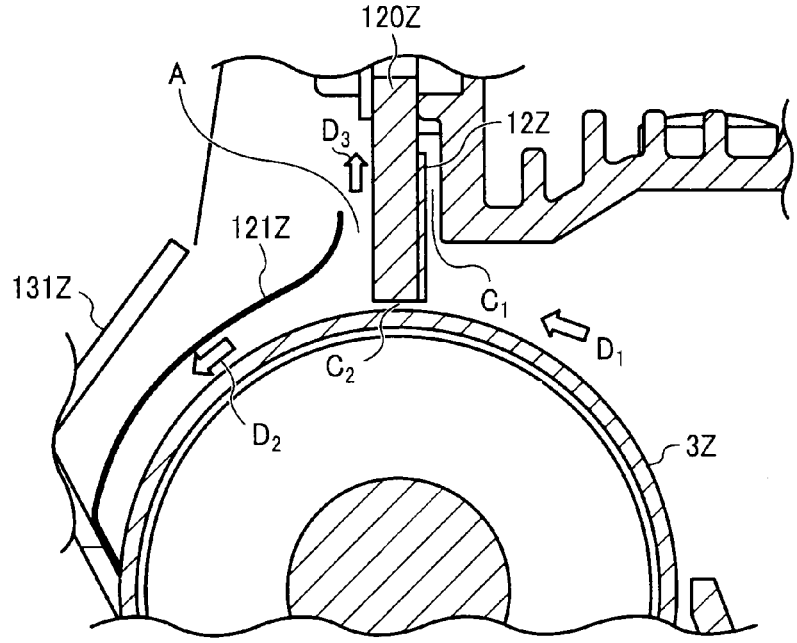
FIG. 9B is an enlarged view illustrating the comparative development device in which the development-side seal and the developer regulator are away from each other.

FIGS. 9A and 9B are enlarged views illustrating a configuration around a developer doctor 120Z facing a development roller 3Z in the comparative development device. In FIG. 9A, a development-side seal 121Z and the developer doctor 120Z are in contact with each other, whereas, in FIG. 9B, the development-side seal 121Z and the developer doctor 120Z are away from each other.

As shown in FIGS. 9A and 9B, also in the comparative development device, the development-side seals 121Z serving as covers or seal members are provided downstream from the regulation gap in the direction of rotation of the development roller 3Z to cover axial end portions of the development roller 3Z and the developer doctor 120Z outside the image area. The development-side seals 121Z are designed to prevent scattering of developer that has passed through clearances $C_2$ at the axial ends of the regulation gap between the development roller 3Z and the developer doctor 120Z.

It is to be noted that, in this specification, the regulation gap and the clearances $C_2$ respectively mean the axial center portion (in the image area) and the axial end portions of the clearance between the developer bearer and the developer regulator.

However, it is preferred to prevent passage of the developer through the clearances $C_2$ itself.

More specifically, magnetic members forming the magnet roller are not present outside the development range in the axial direction, and it is not designed to convey developer through clearances $C_2$ between the development roller 3Z and the developer doctor 120Z in the axial end portions. In practice, however, among the developer conveyed toward the regulation gap as indicated by arrow $D_1$, the developer that is prevented from passing through the regulation gap by the developer doctor 120Z is pushed to the axial ends long the magnetic plate 12Z.

The developer that is pushed to the axial end portions moves through the clearance $C_1$, shown in FIGS. 9A and 9B, between the development casing and the magnetic plate 12Z. The developer that has reached the axial ends then inevitably moves through the clearances $C_2$ between the development roller 3Z and the developer doctor 120Z. In the axial end portions, the developer can easily leave the surface of the development roller 3Z because the effects of the magnetic force exerted by the magnet roller are small. Accordingly, it is still possible that the developer scatters outside the comparative development device even through the development-side seals 121Z can inhibit it to some extent.

Additionally, to supply developer to the development roller 3Z, the conveyance screw (supply screw 8) conveys the developer in the longitudinal direction (width direction) of the development roller 3Z while agitating toner and carrier in the developer. Therefore, the developer is more likely to scatter in the downstream end portion in the direction in which the supply screw conveys the developer.

Moreover, in the area where the magnets of the magnet roller present, the developer carried on the surface of the development roller 3Z is retained along the magnetic force lines, thus inhibited from moving in the thrust direction (width direction). By contrast, in the axial end portions of the development roller 3Z, there are magnetic force lines heading further to the ends in the thrust direction from the axial ends of the magnets of the magnet roller. Accordingly, some developer moves in the thrust direction through the clearance $C_2$ between the development roller 3Z and the developer doctor 120Z.

Although it is preferred that the developer be retained along the magnetic force lines, doing so is difficult because the development roller 3Z rotates, resulting in scattering of developer.

In view of the foregoing, in the development device 2 according to the present embodiment, the doctor end seals 125 are provided in the respective axial end portions outside the image area and disposed in contact with the upstream face 12A of the magnetic plate 12 in the direction of rotation of the development roller 3. The doctor end seals 125 can fill in the clearance $C_1$ shown in FIGS. 9A and 9B and prevent the developer moving through the clearance $C_1$ to the axial end portions outside the image area. This configuration can inhibit the developer from moving through the clearances $C_2$ between the development roller 3 and the developer doctor 120 in the area where the effects of the magnetic force exerted by the magnet roller 304 is smaller. Thus, scattering of developer can be gap inhibited.

Referring again to FIGS. 9A and 9B, another inconvenience in the comparative development device is described below.

If developer passes through the axial end portions, the developer can accumulate in an area A shown in FIGS. 9A and 9B. Then, it is possible that the developer pushes away the upper end portion of the development-side seal 121Z as indicated by arrow $D_3$ shown in FIG. 9B, creating a clearance between the development-side seal 121Z and the developer doctor 120Z. Additionally, the second end portion (downstream end portion) of the development-side seal 121Z is fixed at a position downstream from the developer doctor 120Z in the direction of rotation of the development roller 3Z, and the first end portion (upstream end portion) is in contact with the developer doctor 120Z due to this elasticity. Accordingly, if the developer conveyed by rotation of the development roller 3Z comes into contact with the development-side seal 121Z, the developer disengages the development-side seal 121Z from the developer doctor 120Z, defying the elasticity of the development-side seal 121Z.

The clearance between the developer doctor 120Z and the development-side seal 121Z is not desirable because it encourages scattering of developer.

By contrast, in the development device 2 according to the present embodiment, as shown in FIG. 5, the flexible sheet member 126 is provided in the clearance $C_2$ between the development roller 3 and the developer doctor 120 to eliminate or reduce the clearance $C_2$ outside the image area, thereby inhibiting the developer from moving directly to the area A shown in FIG. 5.

Although the doctor end seal 125 is fixed to the upper casing 139 in the present embodiment, the portion to which the doctor end seal 125 is attached in not limited thereto as long as it contacts the axial end portions of the upstream face 12A of the magnetic plate 12 in the direction of rotation of the development roller 3. For example, the doctor end seal 125 may be fixed on the side of the developer doctor 120. Additionally, the portion to which the flexible sheet member 126 is attached in not limited to the upper casing 139 as long as the flexible sheet member 126 can be provided in the clearance $C_2$ between the development roller 3 and the developer doctor 120.

As described above, the development device 2 according to the present embodiment includes the development roller 3 serving as the developer bearer, the developer doctor 120, the magnetic plate 12, and the doctor end seals 125 serving as the first axial end seals disposed in contact with the upstream face 12A of the developer regulator (developer doctor 120 and the magnetic plate 12) on the upstream side in the direction of rotation of the development roller 3.

Specifically, the doctor end seals 125 contact the respective axial end portions of the upstream face 12A of the developer doctor 120 and the magnetic plate 12 to fill in the clearances $C_1$ shown in FIGS. 9A and 9B, thereby inhibiting the developer from moving further to the respective axial end portions. Thus, being blocked by the doctor end seal 125, the developer, which tends to move along the surface of the magnetic plate 12 to the axial end portions, can be prevented from moving toward the clearances $C_2$ that are at the axial ends of the regulation gap between the developer doctor 120 and the development roller 3. Consequently, scattering of developer can be inhibited.

The development device 2 further includes the flexible sheet member 126 that extends from the first end portion fixed to the doctor end seal 125 downstream from the regulation gap in the direction of rotation of the development roller 3 through the clearance $C_2$. The seal members 126 can reduce the size of the clearances $C_2$ at the axial ends of the regulation gap, thereby inhibiting passage of developer therethrough. The flexible sheet member 126 passing though the clearance $C_2$ at the axial end of the regulation gap can inhibit accumulation of developer in the area A adjacent to the position where the development-side seal 121 contacts the developer doctor 120, thereby preventing creating of clearance between the developer doctor 120 and the development-side seal 121.

Additionally, the second end portion 126A of the flexible sheet member 126 is positioned upstream in the direction of rotation of the development roller 3 from the development range where development roller 3 faces the photoreceptor 1, or upstream from the line LH (shown in FIG. 3) passing through axial centers of the development roller 3 and the photoreceptor 1. Thus, the length of the flexible sheet member 126 in the circumferential direction of the development roller 3 is designed not to reach the development range, where the distance between the development roller 3 and the photoreceptor is shortest. Thus, it does not reduce the gap with the development-side seal 121.

Additionally, the flexible sheet member 126 and the development-side seal 121 are similar in length in the width direction (axial direction of the development roller 3). Accordingly, the area A can be covered with the flexible sheet member 126 entirely in the width direction.

Additionally, the image forming apparatus 500 according to the present embodiment includes the photoreceptor 1 serving as the latent image bearer, the charging device 302 to charge the photoreceptor 1, the optical writing unit 21 to form a latent image on the photoreceptor 1, the development device 2 to develop the latent image, and the drum cleaning unit 301 to remove toner remaining on the photoreceptor 1 after image transfer. The image forming apparatus 500 can inhibit contamination inside the apparatus and scattering of toner on output images.

Next, a variation of the above-described development device 2 is described below with reference to FIGS. 10 and 11.

In the variation, another seal member is provided to an axial end portion of the opening rim 131 to prevent scattering of developer from the axial end portions of the developer doctor 120.

Figure 10:
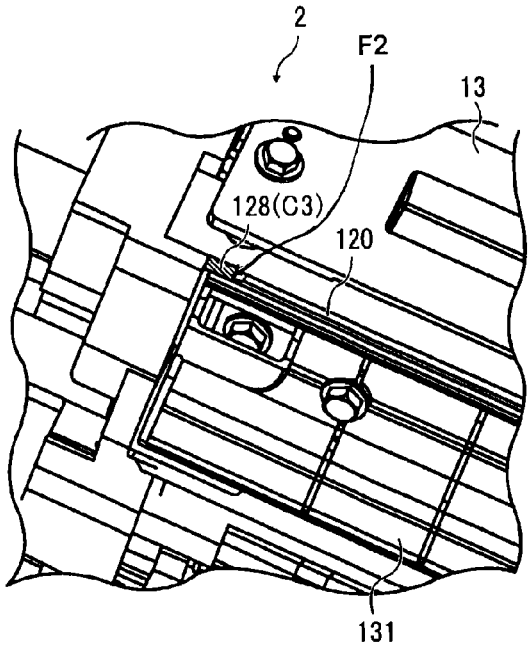
FIG. 10 is an enlarged perspective view illustrating a development device including a seal member provided to the rim portion of the development casing enclosing an opening formed in the development casing.

FIG. 10 is an enlarged perspective view illustrating an axial end portion of the development device 2 according to the variation in which a casing-side seal 128 (third axial end seal) is provided to the opening rim 131 as viewed from above. FIG. 11 is an enlarged view of an axial end portion (on the left in FIG. 4) of the opening rim 131 to which the casing-side seal 128 is provided.

As described above, the developer that is prevented from passing through the regulation gap is pushed to the axial ends long the magnetic plate 12. When the developer reaches the axial end portions of the developer doctor 120, it is possible that, even if the clearance $C_2$ is very small, the developer urged by the pushing force can pass through the clearance $C_2$ between the development casing 13 and the end portion of the developer doctor 120 and scatter.

Figure 11:
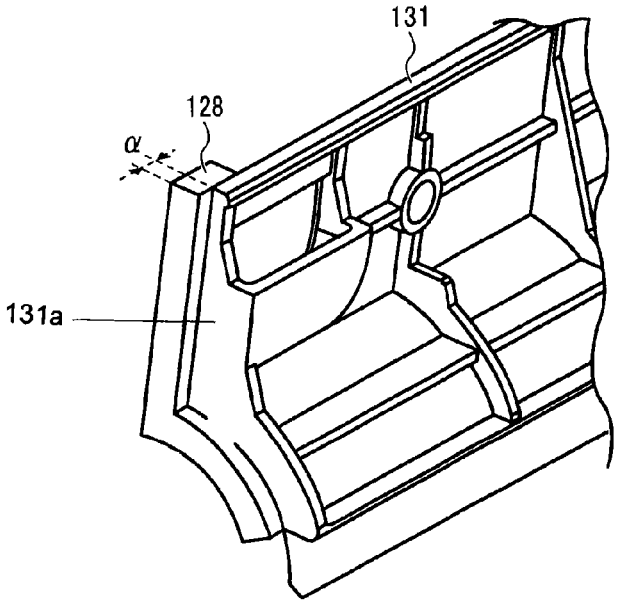
FIG. 11 is an enlarged view illustrating an axial end portion of the development device shown in FIG. 10.

In view of the foregoing, in the configuration shown in FIGS. 10 and 11, the casing-side seals 128 are provided to the axial end portions of the developer doctor 120 to prevent scattering of developer. The casing-side seal 128 are fixed to the axial end portion 131*a* of the opening rim 131 and may be in contact with the side face or axial end face F2 (shown in FIG. 5) of the developer doctor 120 at the axial end, thus filling in a clearance C3 between the side face F2 of the developer doctor 120 and the development casing 13. The clearance C3 between the developer doctor 120 and a side plate of development casing 13 can be thus filled in, and developer can be prevented from moving in the thrust direction.

Additionally, the casing-side seal 128 are fixed to the opening rim 131 with an axial end portion α projecting beyond the axial end of the opening rim 131 (in the width direction). The projecting portion α may be folded along the side face of the development casing 13. Thus, the clearance between the opening rim 131 and the side face of the development casing 13 can be filled in, preventing scattering of developer therefrom, and clearances created between the adjacent components, namely, the opening rim 131, the development casing 13, and the developer doctor 120, can be covered better.

It is to be noted that various aspects of this specification can adapt to any image forming apparatus, such as a printer or a facsimile machine, that includes a development device not limited to copiers.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development casing;

a developer bearer to carry by rotation two-component developer including toner and carrier, the developer bearer disposed facing a latent image bearer through an opening formed in the development casing;

a magnetic field generator disposed inside the developer bearer;

a developer regulator to adjust an amount of developer carried on the developer bearer, the developer regulator extending in an axial direction of the developer bearer perpendicular to a direction of rotation of the developer bearer and disposed with an end face thereof facing the developer bearer across a predetermined regulation gap; and a first axial end seal provided in an axial end portion of the development device outside an image range, the first axial end seal disposed in contact with an upstream face of the developer regulator in the direction of rotation of the developer bearer to reduce a size of a clearance ($C_1$) between the developer regulator and the development casing.

2. The development device according to claim 1, further comprising:

a flexible second axial end seal having a first end portion fixed to the first axial end seal and a second end portion disposed downstream from the regulation gap in the direction of rotation of the developer bearer, the second axial end seal passing through a clearance ($C_2$) at an axial end of the regulation gap between the development bearer and the developer regulator; and a cover disposed downstream from the developer regulator in the direction of rotation of the developer bearer to cover the second end portion of the second axial end seal.

3. The development device according to claim 2, wherein the second end portion of the second axial end seal is positioned upstream from the development range in the direction of rotation of the developer bearer.

4. The development device according to claim 2, wherein the second axial end seal and the cover are similar in length in the axial direction of the developer bearer.

5. The development device according to claim 2, wherein the first axial end seal is elastic, and a sum of a thickness of the first axial end seal and a thickness of the second axial end seal is greater than a thickness of the clearance ($C_1$) between the developer regulator and the development casing.

6. The development device according to claim 1, further comprising a third axial end seal to fill in a clearance (C3) between an axial end face of the developer regulator and the development casing, wherein the development casing comprises a rim portion adjacent to the opening, the rim portion covering a downstream side of the developer regulator in the direction of rotation of the developer bearer, and the third axial end seal is fixed to an axial end portion of the rim portion and disposed in contact with the axial end face of the developer regulator.

7. The development device according to claim 6, wherein the third axial end seal is fixed to the rim portion of the development casing with an outer end portion of the third axial end seal projecting beyond an axial end of the rim portion of the development casing.

8. An image forming apparatus comprising:

a latent image bearer;

a latent image forming unit to form a latent image on the latent image bearer; and a development device to develop the latent image, the development device including:

a development casing;

a developer bearer to carry by rotation two-component developer including toner and carrier, the developer bearer disposed facing the latent image bearer through an opening formed in the development casing;

a magnetic field generator disposed inside the developer bearer;

a developer regulator to adjust an amount of developer carried on the developer bearer, the developer regulator extending in an axial direction of the developer bearer perpendicular to a direction of rotation of the developer bearer and disposed with an end face thereof facing the developer bearer across a predetermined regulation gap; and a first axial end seal provided in an axial end portion of the development device outside an image range, the first axial end seal disposed in contact with an upstream face of the developer regulator in the direction of rotation of the developer bearer to reduce a size of a clearance ($C_1$) between the developer regulator and the development casing.

9. The development device according to claim 1, wherein the upstream face of the developer regulator faces in a direction away from the latent image bearer in a direction towards an inside of the developing device.

10. The development device according to claim 3, wherein the second axial end seal and the cover are similar in length in the axial direction of the developer bearer.

11. The development device according to claim 2, further comprising a third axial end seal to fill in a clearance (C3) between an axial end face of the developer regulator and the development casing, wherein the development casing comprises a rim portion adjacent to the opening, the rim portion covering a downstream side of the developer regulator in the direction of rotation of the developer bearer, and the third axial end seal is fixed to an axial end portion of the rim portion of the development casing and disposed in contact with the axial end face of the developer regulator.

12. The development device according to claim 11, wherein the third axial end seal is fixed to the rim portion of the development casing with an outer end portion of the third axial end seal projecting beyond an axial end of the rim portion of the development casing.

13. A development device comprising:

a development casing;

a developer bearer to carry by rotation two-component developer including toner and carrier, the developer bearer disposed facing a latent image bearer through an opening formed in the development casing;

a magnetic field generator disposed inside the developer bearer;

a developer regulator to adjust an amount of developer carried on the developer bearer, the developer regulator extending in an axial direction of the developer bearer perpendicular to a direction of rotation of the developer bearer and disposed with an end face thereof facing the developer bearer across a predetermined regulation gap; and a third axial end seal to fill in a clearance (C3) between an axial end face of the developer regulator and the development casing, wherein the development casing comprises a rim portion adjacent to the opening, the rim portion covering a downstream side of the developer regulator in the direction of rotation of the developer bearer, and the third axial end seal is fixed to an axial end portion of the rim portion of the development casing and disposed in contact with the axial end face of the developer regulator.

14. A development device according to claim 13, wherein the third axial end seal is fixed to the rim portion of the development casing with an outer end portion of the third axial end seal projecting beyond an axial end of the rim portion of the development casing.

15. A development device according to claim 13, wherein the rim portion is separate from the development casing.

* * * * *